United States Patent [19]

Scott et al.

[11] 4,335,388

[45] Jun. 15, 1982

[54] NULL CONTROL OF MULTIPLE BEAM ANTENNA

[75] Inventors: William G. Scott, Saratoga; Edgar W. Matthews, Jr., Los Altos; Howard H. S. Luh, Sunnyvale, all of Calif.; Charles A. Klein, Centerburg, Ohio

[73] Assignee: Ford Aerospace & Communications Corp., Dearborn, Mich.

[21] Appl. No.: 168,964

[22] Filed: Jul. 14, 1980

Related U.S. Application Data

[63] Continuation of Ser. No. 13,597, Feb. 21, 1979, abandoned.

[51] Int. Cl.[3] ..... H01Q 3/30

[52] U.S. Cl. ..... 343/854; 343/100 LE

[58] Field of Search ..... 343/778, 853, 854, 100 SA, 343/100 LE

[56] References Cited

PUBLICATIONS

Dion; Optimization of a Communication Satellite Multiple-Beam Antenna, Lincoln Lab, MIT, Tech Note 1975-39, May 27, 1975, pp. 20-41.

Tomiyasu; Sequential Phasing in Multiple Beam Antenna for Interference Reduction; 1977 IEEE AP-S Symposium Digest, pp. 428-431.

Dion et al.; A Variable-Coverage Satellite Antenna System; Proc. IEEE, Feb. 1971, pp. 252-262.

*Primary Examiner*—Eli Lieberman

*Attorney, Agent, or Firm*—Peter Abolins; Clifford L. Sadler

[57] ABSTRACT

This specification discloses a multibeam antenna which produces a null at one or more specified points with greater frequency band width for a given null depth. For example, a ring of beams about the null are set to have a phase difference between adjacent beams of 360° divided by the number of beams in the ring. The amplitude of each of the beams is chosen so that each such ring set is self-nulled at the intended null and any common change in the side lobes of all beams of a ring set at the null due to frequency change is substantially equal. Thus, even with change in frequency, the null depth and position is substantially unchanged.

21 Claims, 29 Drawing Figures

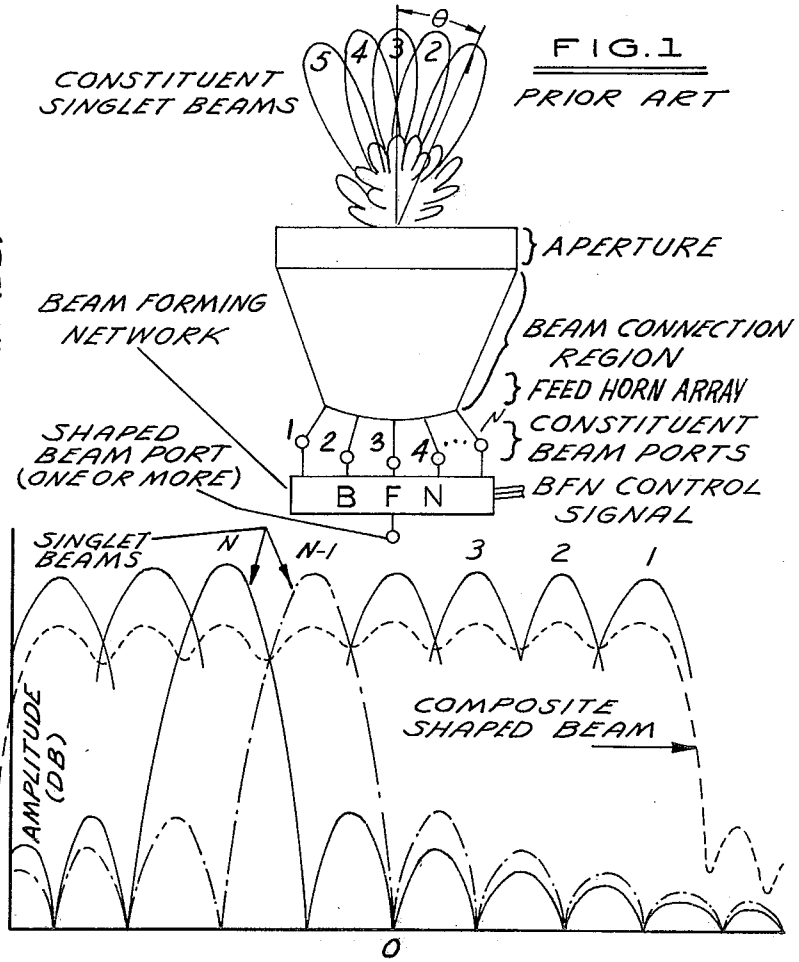
FIG. 1
PRIOR ART
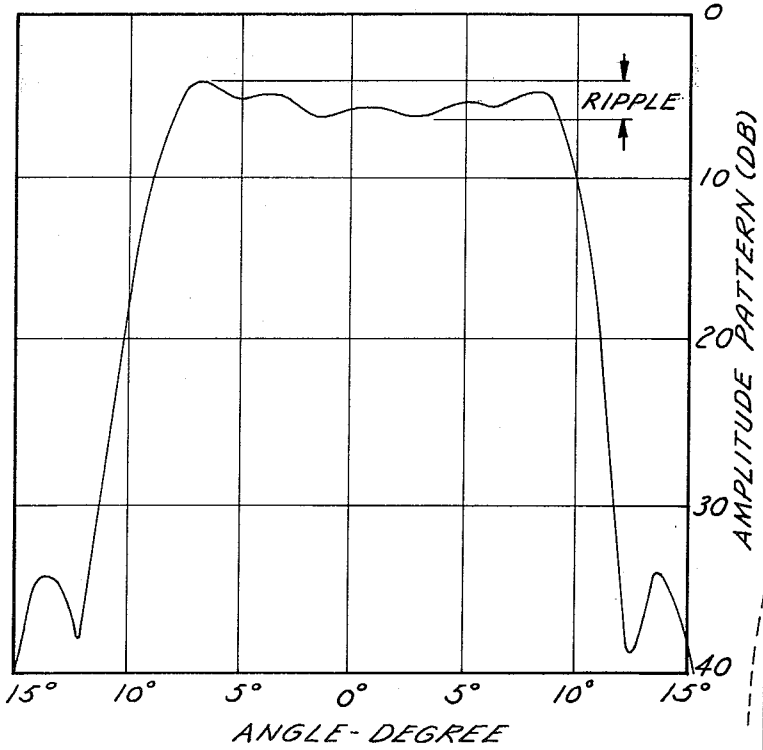
FIG. 2
PRIOR ART
FIG. 4
PRIOR ART

60° PHASE INCREMENTS

FREQUENCY
7.35 GHz = fo

FREQUENCY
7.2 GHz = fo - 2%

FREQUENCY
7.5 GHz = fo + 2%
NULL
RELATIVE POWER (DB)
ANGLE °
0
10
20
30
0°
5°
10°
15°

NULL CONTROL OF MULTIPLE BEAM ANTENNA

This is a continuation of application Ser. No. 13,597, filed Feb. 21, 1979, now abandoned.

BACKGROUND OF THE INVENTION (1) Field of the Invention

This invention relates to antenna systems which electronically control antenna beams; and, in particular, to such antenna systems capable of producing nulls in their radiation patterns.

(2) Prior Art

A multiple beam antenna can be formed using an array of antenna elements, a lens, or a reflector, and can have an adjustable amplitude and/or phase control of each constituent beam. These adjustable phase and amplitude controls are set to provide an excitation in accordance with a desired radiation pattern. That is, the multiple beam antenna can have a composite far field radiation pattern which is adjustable, and thus provide variable coverage.

A multiple beam antenna pattern may be formed with one or more narrow, deep depressions, often termed nulls, within a wide, flat-top shaped beam antenna pattern. Generating nulls is particularly advantageous to minimize the deleterious effects of discrete sources of interfering radiation which impinge on the antenna aperture while the antenna provides radio communication in other directions. In satellite communications it may be desirable to aim a null at a jamming source while maintaining coverage of the antenna beam pattern in other angular regions.

For example, in "Optimization of a Communication Satellite Multiple Beam Antenna" written by A. R. Dion, Lincoln Laboratory, Massachusetts Institute of Technology, Lexington, Mass., Technical Note 1975-39, May 27, 1975, pages 20 through 41, it is taught how to form a beam pattern by adjusting the phase and amplitude excitation of all ports equally except for one, two or three contiguous ports, whose composite beam points in the direction desired for a null. In each desired null direction the appropriate composite beam port excitation is adjusted in amplitude and/or phase so that each such composite beam cancels the residual field of the other remaining, uniformly excited ports in the desired null direction. The null is obtained by a subtraction of equal amplitude fields.

A generalized prior art Multi-Beam Antenna is shown in FIG. 1. It consists of an aperture (which could be an offset parabolic reflector, a microwave lens, or a phased array), a beam connection region (e.g. feed horns at the focal region of a reflector, a lens or a hard-wired multibeam array), and multiple beam ports, i.e., one port for each secondary pencil beam. A conical cluster of N overlapping pencil beams is associated with a set of N beam ports. To form a single controllable shaped beam, an N-port-to-one-port Beam Forming Network (BFN) provides control of relative amplitude and phase of the energy being summed from the N beam ports to the one final shaped beam port. Multiple shaped beams may be produced by establishing the proper interconnections and excitations within the BFN.

FIG. 2 shows typical radiation patterns of a set of multiple beams, together with a typical composite pattern formed by simple summation of individual beams in the same phase. If all beams, for example, of a triangular grid of 61 beams are driven simultaneously, beam excitation may be specified by means of a beam excitation diagram as shown in FIG. 3, wherein an arrow in each circular beam contour indicates excitation phase by twist angle and excitation magnitude by arrow length. The magnitude of the twist angle is measured in a clockwise direction from a vertical reference line. FIG. 3 shows the case of equal phase and amplitude of all 61 beams. The excitation of FIG. 3 results in a nearly flat-topped low-ripple, wide shaped beam as in FIG. 4. To communicate with stations in the flat top of the beam, it may be desirable to minimize discrete reception, or radiation, of signals in other discrete directions, such as point A of FIG. 5, by modifying beam excitations so as to create a deep narrow pattern depression (termed a "null") centered on point A. If the null excitations are optimized at a frequency $f_o$ then at other frequencies $f_1$, $f_2$, etc., progressively displaced from $f_o$, changes in sidelobes of constituent pencil beams (singlets) generally spoil the null at point A, causing increasing null fill-in as in FIG. 5.

Referring to FIG. 6, there is shown a simplified drawing of a field subtraction excitation technique for nulling consisting of reversing the phase of a narrow beam, or a contiguous group of beams, such as a doublet (two beams) or a triplet (three beams). The subtraction technique next involves reducing the reversed beam's amplitude so that the peak of the narrow subtracting beam just cancels the residual sidelobe fields from the other co-phased beams. The angular point of cancellation forms the bottom of the desired pattern null. When the null is positioned within a single beam (e.g., A or B in FIG. 6) the field subtraction null process can be done with that single beam. For a null centered between two contiguous singlets (e.g., C and D), the CD doublet is driven equally but reduced in amplitude, with phase adjusted to cancel residual sidelobe fields of the other beams. Similarly, three beams (e.g., E, F and G) can be driven together and phase reversed to create a subtraction null at the center of the triplet beam. Two noncontiguous nulls within the flat topped beam can be achieved by the use of beams at both nulls (e.g., A and B) which are each out of phase with the local residuals at the null. Further, if needed, nulls can be steered to any point in a local unit cell about the singlet, doublet or triplet null point by unequal excitation of the composite subtraction beam amplitudes.

Other prior art inclues a publication by Kiyo Tomiysu entitled "Sequential Phasing in Multiple Beam Antenna for Interference Reduction", 1977 IEEE AP-S Symposium Digest, pp 428–431 which discloses steering of a null by subtraction with uneven excitation of 2, 3 or 4 contiguous beams. Beams surrounding the null are given a sequential increasing phase excitation. The purpose of this sequential phase excitation of adjacent beams is to be able to use a simple control algorithm to steer the null covered by the three beams while reducing the residual sidelobes from surrounding coverage beams. That is, the particular phase and amplitude of the surrounding beam excitations is used to pull down and hold down the level of their sidelobes so as to simplify phase control of the nulling composite beam. The article does not disclose any particular arrangement of excitation phases so as to reduce the effect on the nulls of changing the frequency of operation.

If there is a requirement such as maintaining a minimum desired gain over the anenna beam coverage over a 4% bandwidth, and requiring that the coverage include a null of specified depth, it has been determined that it is more difficult to maintain the null using prior art techniques than to maintain the gain over the required bandwidth. That is, it is relatively easy to maintain the gain of the antenna beam pattern over the 4% bandwidth and relatively difficult to maintain a sufficiently deep null over the 4% bandwidth using the previously described subtraction technique.

Although the prior art teaches a way of providing a null in a specified composite pattern, such as the subtraction technique discussed above, there are often undesirable side effects such as a change in the composite pattern in other directions, and a change in the composite pattern as a function of frequency, wherein a null is frequency dependent. It has been a problem in communication systems to provide a desired null depth over relatively wide frequency bandwidths for a fixed set of beam port excitations. These are some of the problems this invention overcomes.

SUMMARY OF THE INVENTION

In accordance with an embodiment of this invention, multiple beam antenna port excitations maintain a flat-topped, low-ripple shaped beam including a null at one or more specified points with much greater frequency bandwidth than the prior art for a given null depth. An antenna assembly in accordance with an embodiment of this invention has a plurality of antenna elements and a phase rotation means coupled to the antenna elements to adjust the phase of a signal applied to each of the antenna elements. The beam port excitation includes phase rotation nulling wherein, in one particular embodiment, a narrow beam at the null point can be turned off, and each ring of beams which are equidistant from the null point are set with equal amplitude and progressive phase increments of $$\frac{M(360°)}{N_R},$$

wherein $N_R$ is the numer of beams per equidistant ring set and M is an integer ($\pm 1$, $\pm 2$, $\pm 3$, etc.).

This invention provides a much wider instantaneous frequency bandwidth than prior art, which is particularly advantageous for interference rejection using radiation pattern null shaping with a variable shaped beam antenna formed of a single aperture multiple beam antenna. This invention provides the ability to set the excitations (the adjustable phase and amplitude controls of the beams) so as to provide a null in a specified composite pattern without materially changing the composite pattern in other directions. The generated nulls minimize the deleterious effect of discrete sources of interfering radiation which illuminate the antenna aperture, while the antenna provides radio communications to other directions. The ability of this invention to provide the desired null depths over relatively wide frequency bandwidths for a fixed set of beam port excitations is advantageous in a variety of communications systems.

BRIEF DESCRIPTION OF THE DRAWINGS

FIG. 1 is a block diagram of a single aperture prior art multiple beam antenna and beam pattern;

FIG. 2 is a plot of the amplitude versus beam angle of a plurality of prior art multiple single beams formed into a composite shaped beams;

FIG. 4 is a computer calculated graphical representation of a prior art radiation pattern showing the antenna beam magnitude versus angle from the forward, or zero, azimuth position with all the beams of a composite such as in FIG. 3 uniformly excited

Figure 3:
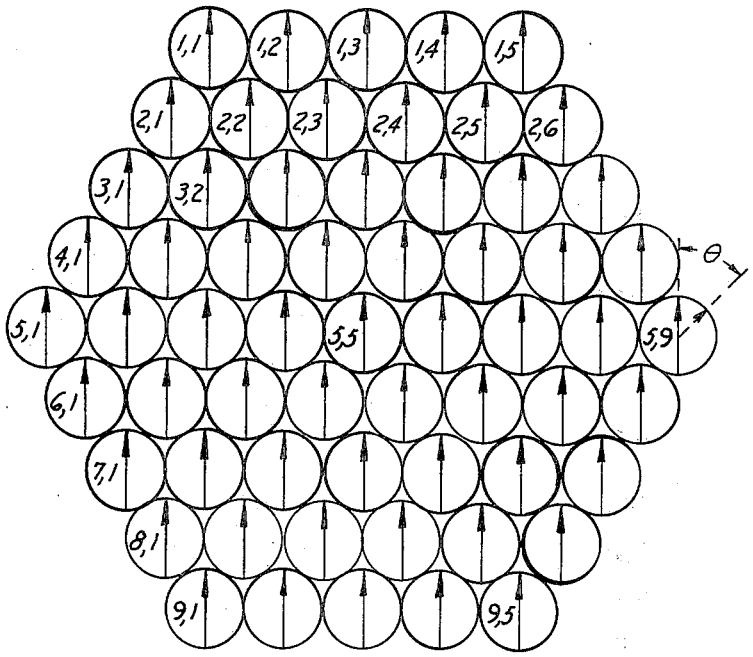
FIG. 3 PRIOR ART
FIG. 3 is a prior art beam excitation diagram including a constituent beam designation number.
Figure 5:
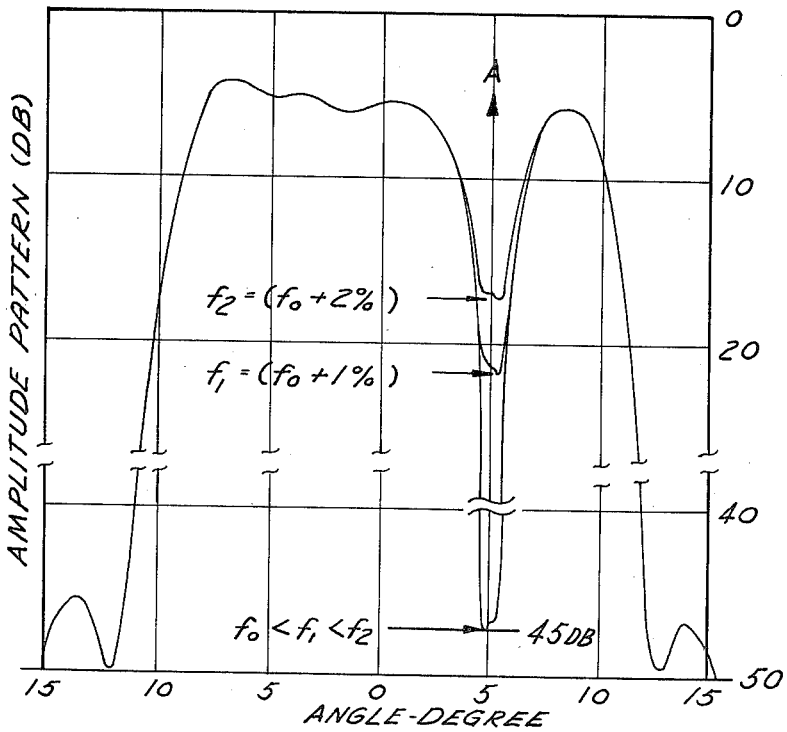
FIG. 5 PRIOR ART
FIG. 5 is a computer calculated graphical representation similar to FIG. 4 wherein one singlet of a composite beam such as shown in FIG. 3 has a radiation pattern which subtracts from the remaining beams to form a null of varying depths at different frequencies, as is shown for $F_o$, $f_1$ and $f_2$.
Figure 6:
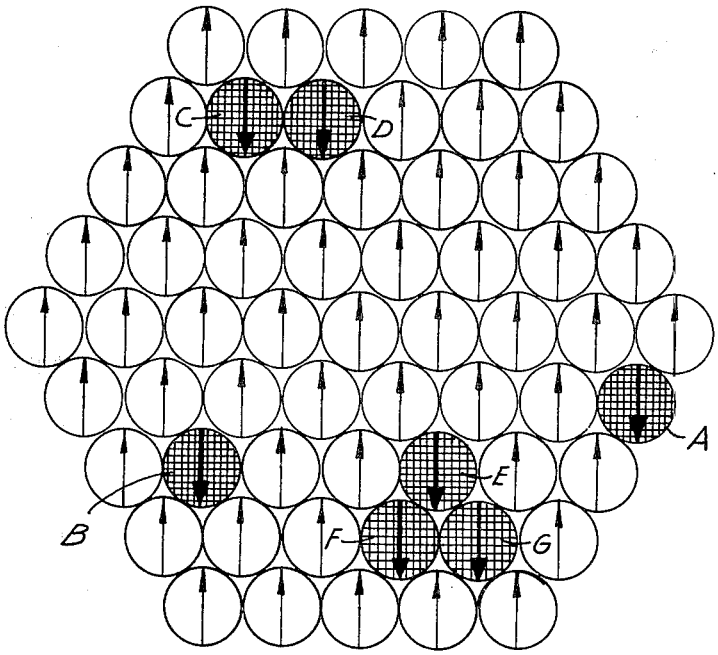
FIG. 6 PRIOR ART
FIG. 6 is a view similar to FIG. 3 wherein nulls are created by subtraction of a singlet beam, A, a doublet beam, C and D, and a triplet beam, E, F and G.
Figure 8:
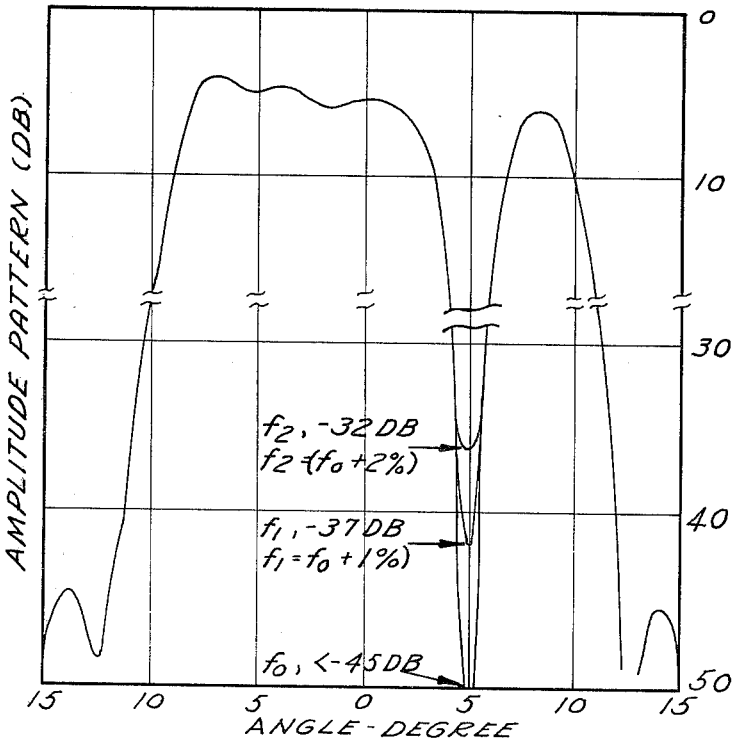
Figure 9:
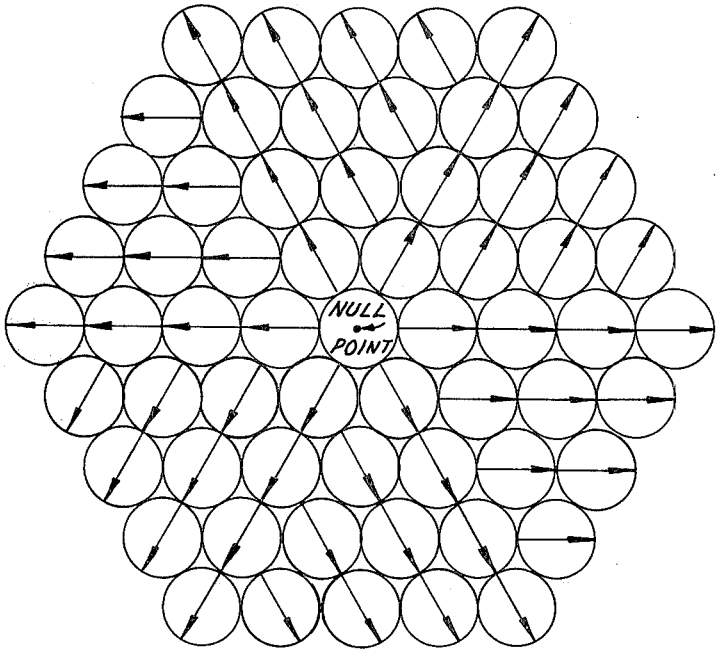
Figure 10:
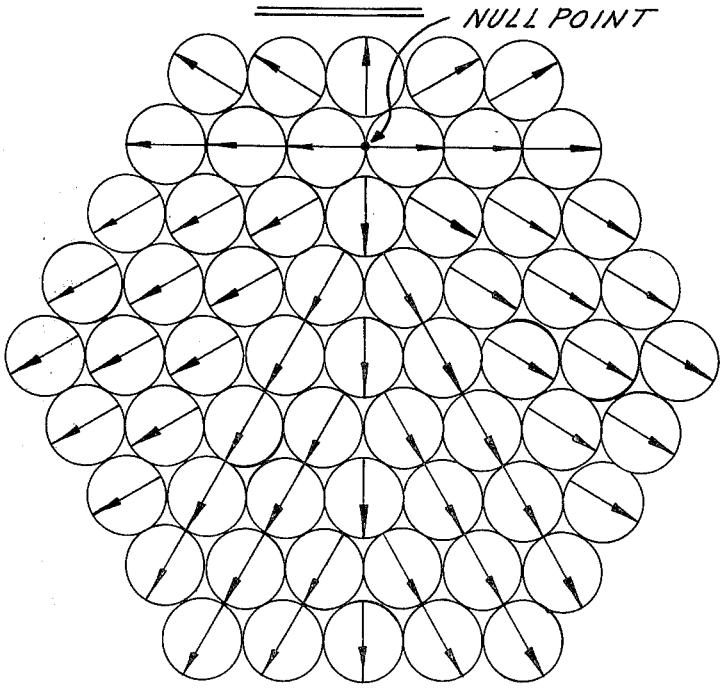
Figure 11:
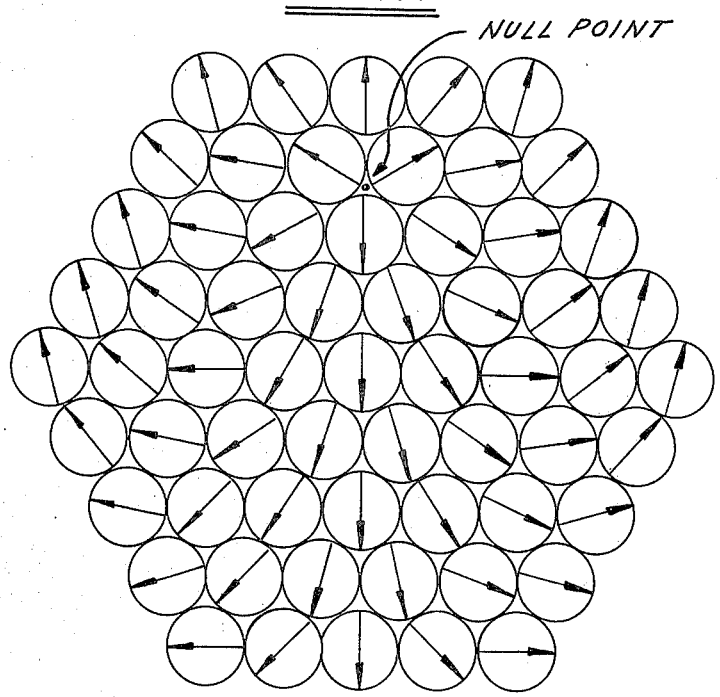
Figure 12:
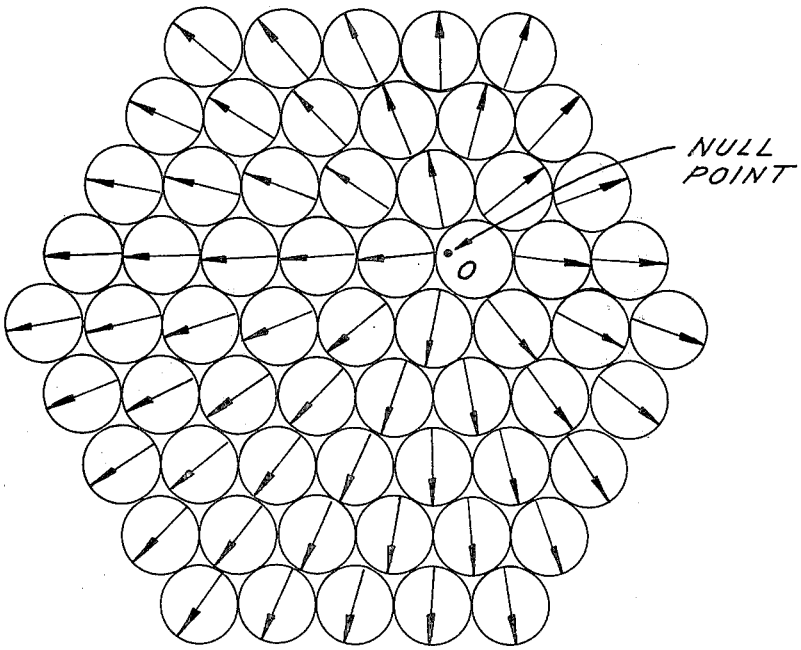
Figure 13:
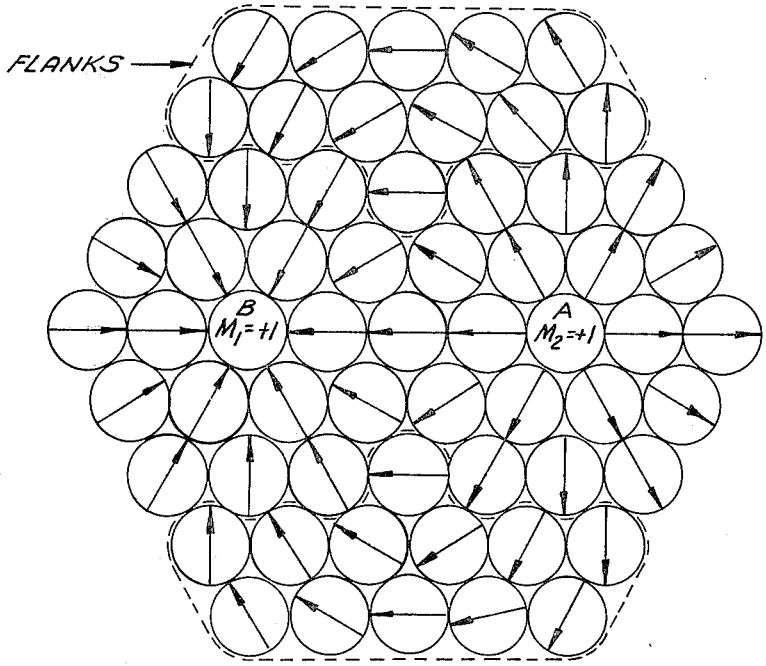
Figure 14:
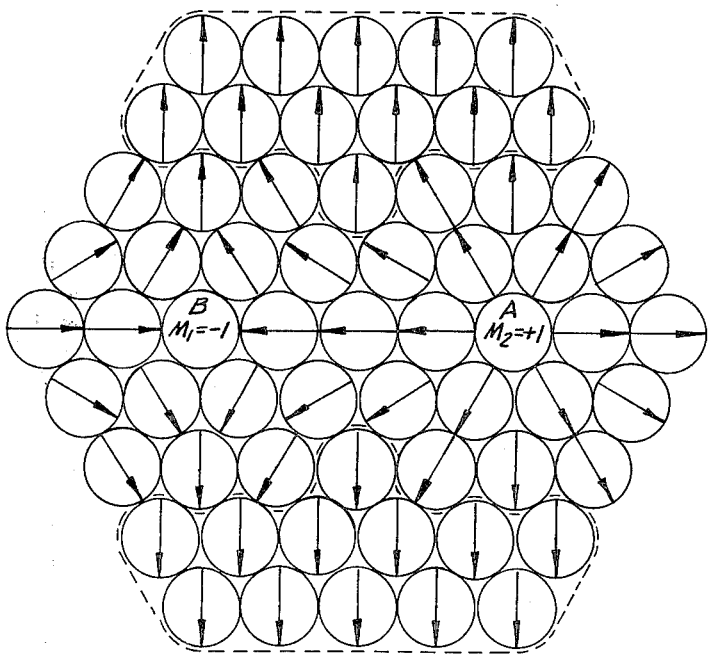
Figure 15:
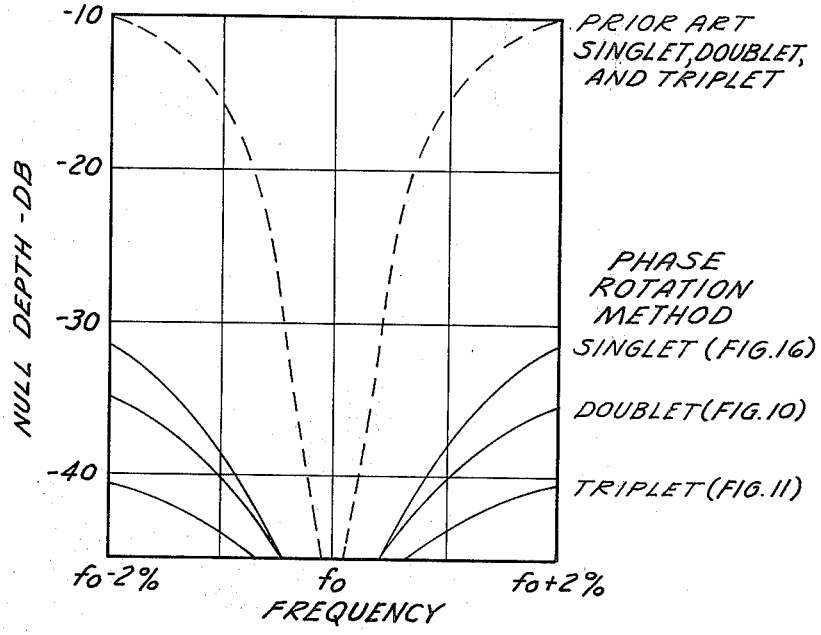
Figure 21:
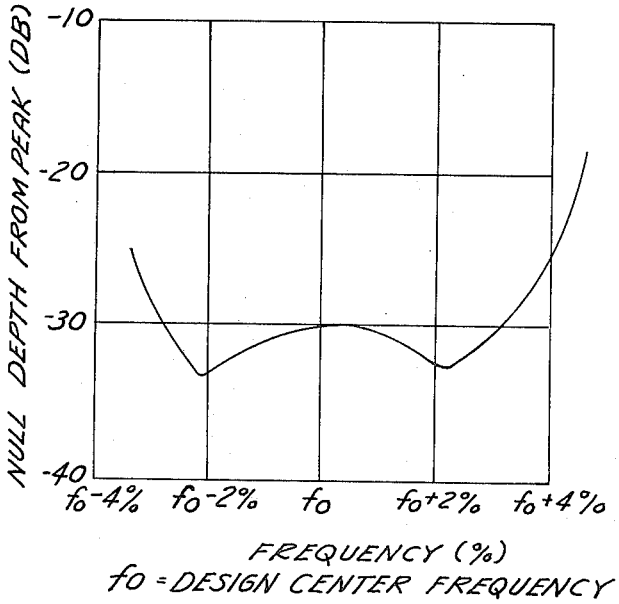
Figure 16:
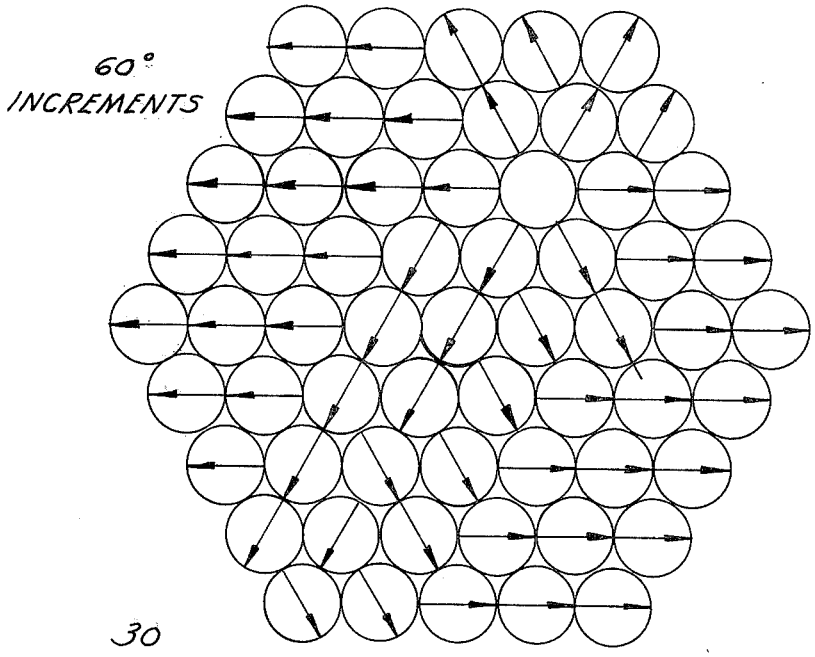
Figure 17:
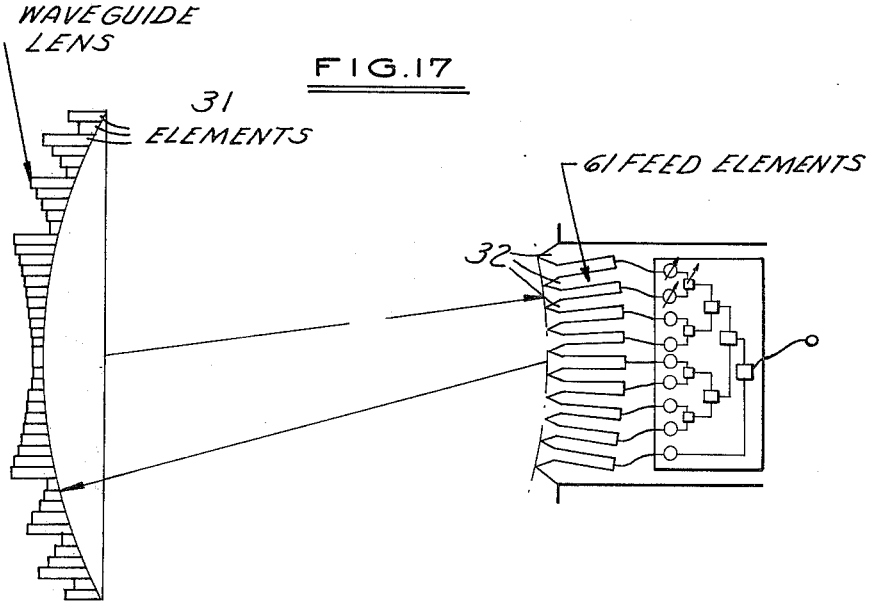
Figures 18, 19, 20:
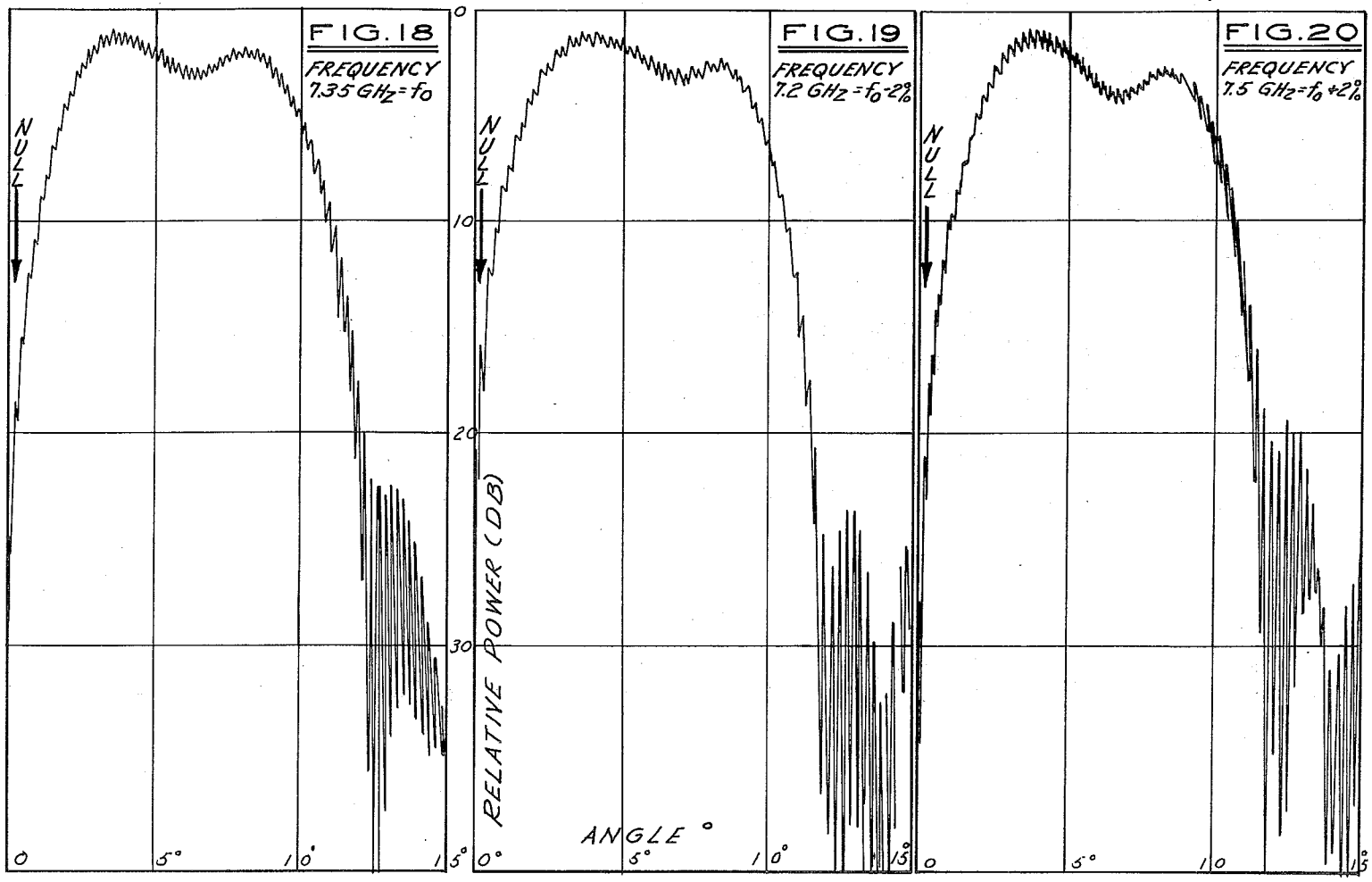
Figure 22:
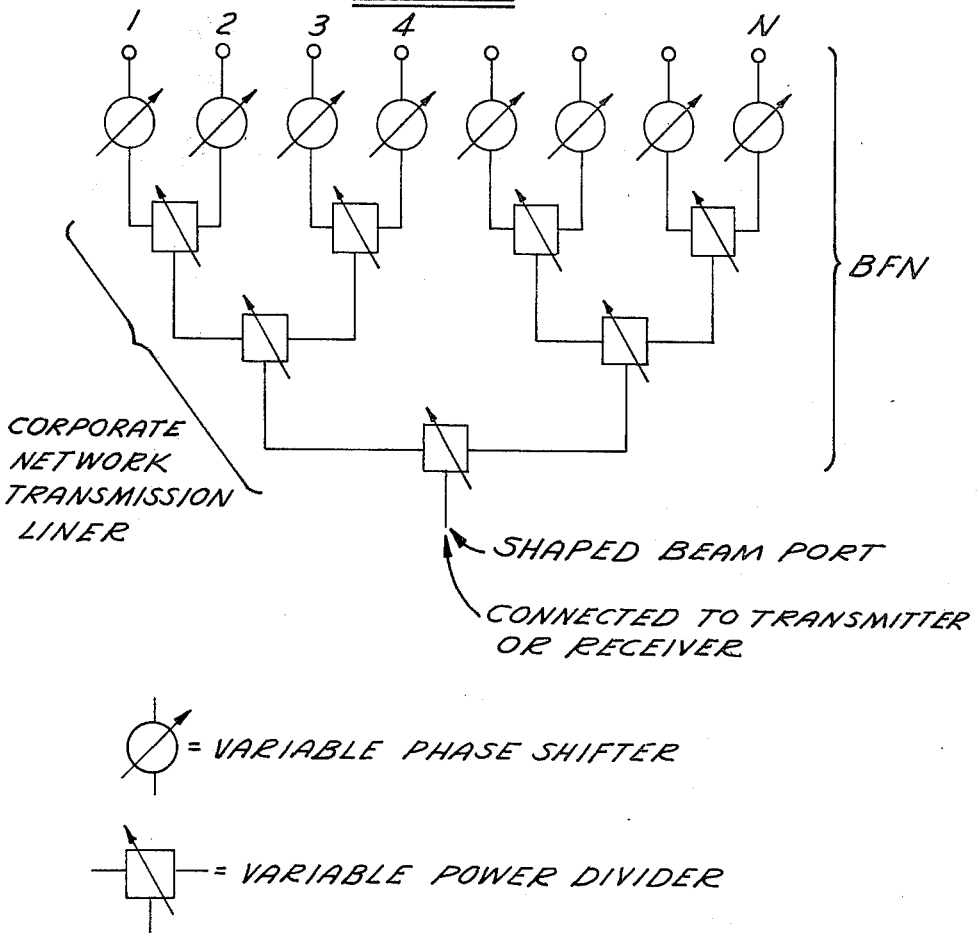
PRIOR ART FIG. 22

FIG. *7a* is a view similar to FIG. 3 with the phasors arranged about a null point A in partial hexagonal rings $R_1$, $R_2$, $R_3$, $R_4$, $R_5$, $R_6$ and $R_7$ in accordance with an embodiment of this invention;

FIG. *7b* is a representation of the field phasors at point A from ring $R_1$ as if they are emanating from a single point, and showing that the ring itself is nulled at point A in accordance with an embodiment of this invention;

FIGS. *7c, 7d, 7e, 7f, 7g* and *7h* are similar to FIG. *7b* and are associated with rings $R_2$, $R_3$, $R_4$, $R_5$, $R_6$, and $R_7$, respectively;

FIG. 8 is a figure similar to FIG. 5 except that the null is created by phase rotation in accordance with an embodiment of this invention, and showing that the null is substantially less sensitive to frequency changes than in the prior art;

FIG. 9 is a view similar to FIG. 3 with the addition of quantized phase rotation about a null in accordance with an embodiment of this invention;

FIG. 10 is a view similar to FIG. 9 wherein the null is defined by a doublet and the excitation phases are shown in accordance with an embodiment of this invention;

FIG. 11 is similar to FIG. 9 with the null defined by a triplet and the phase being in accordance with an embodiment of this invention;

FIG. 12 is a figure similar to FIG. 11 with the null being at a generalized location and the phases being in accordance with an embodiment of this invention;

FIG. 13 is a representation similar to FIG. 12 but including two nulls with similar phase rotation, the excitation being quantized, and there being flanks contained within a dotted outline, in accordance with an embodiment of this invention;

FIG. 14 is similar to FIG. 13 and has two nulls of opposite phase rotation sign in accordance with an embodiment of this invention;

FIG. 15 is a calculated graphical representation comparing null depth versus frequency for the prior art with that achieved in accordance with an embodiment of this invention as shown in FIG. 16, FIG. 10 and FIG. 11;

FIG. 16 is a view similar to FIG. 11 wherein phase rotations are quantized at 60° increments about a null in accordance with an embodiment of this invention;

FIG. 17 is a generally cross sectional view of a waveguide lens and feed elements in accordance with an embodiment of this invention;

FIG. 18 is a measured graphical representation to one side of a null of the antenna pattern of the lens antenna of FIG. 17 with the excitation as in FIG. 9;

FIG. 19 is a measured graphical representation similar to FIG. 18 with the frequency decreased by 2% from FIG. 18;

FIG. 20 is the same as FIG. 18 with the frequency increased 2%;

FIG. 21 is a graphical representation of frequency versus null depth of the experimental performance of the lens antenna embodiment in accordance with FIG. 9; and FIG. 22 is a prior art corporate network transmission lines for coupling N ports to a single transmitter or receiver.

DETAILED DESCRIPTION OF THE INVENTION

Excitation of a multiple beam antenna in accordance with phase rotation includes adjusting the sidelobes of the signal associated with each beam so they cancel at a given point to produce a null. Following are four embodiments for achieving a suitable phase rotation. First, there can be an "exact" phase rotation (or sequence) of null excitations where either: all elements equidistant from a null have progressive equally spaced excitation phases vectorially adding to zero; or elements have an excitation phase given by $m\phi$ where m is some integer and $\phi$ is the spatial angle of the element about the null center. The null center need not lie at the center of a singlet, doublet or triplet beam. Second, there can be quantized phase rotation null excitations wherein exact excitations have been rounded to make all phases discrete values. For example, FIG. 16 shows a quantized version of one excitation set using 60° phase increments. Third, a variation of the above described first and second variations includes the use of "flanks" wherein a group of elements spaced from a null, constituting a "flank", have a constant phase for the purpose of minimizing phase settings and reducing pattern variations over the flank region. Fourth, all of the above variations can be applied to two or more nulls as indicated in, for example, FIGS. 13 and 14.

Referring to FIG. 7(*a*), for a null centered in a singlet at point A, the excitation of a multiple beam antenna includes turning off a narrow beam at the null point and setting each "ring" ($R_1$, $R_2$, $R_3$, $R_4$, $R_5$ and $R_6$) of beams which are approximately equidistant from the null point, with equal amplitude and progressive phase increments of $$\frac{M(360°)}{N_R},$$

where $N_R$ is the number of beams per equidistant ring set and M is an integer ($\pm 1$, $\pm 2$, $\pm 3$, etc.) The resulting phasor diagram of the fields at the null point A for each ring set $R_1$–$R_6$ is symmetrical star, shown in FIGS. 7(*b*) to 7(*g*). Ring $R_7$ is chosen to be nonsymmetrical to improve the gain of the antenna pattern and is discussed further below. As a result, each partial ring (except $R_7$) is self-nulled at A, so that if changes in sidelobes of all beams of a ring set at point A due to frequency change are equal (assuming beam shapes are rotationally symmetric and identical in magnitude) or nearly so as in most real antennas, the self-nulling property will be maintained.

Although the self nulling at A occurs for all values of M, changing the value of M may change the coverage of the antenna at other points in the beam. For example, if M is equal to 2, the adjacent beams in $R_1$ will have a phase difference of 120°, i.e., two times the 60° phase difference shown. Thus, three adjacent beams will have gone through a phase rotation of 360°. Since it is typically desirable to obtain the maximum gain with relatively constant amplitude at all points other than the null, the phase difference between adjacent beams is desired to be minimized. As a result, $M=\pm 1$ will typically be the values of M to be used. The effect of choosing a negative M is that the direction of phase rotation between adjacent beams takes place in the opposite sequence. For example, referring to FIG. 14, the left hand null is formed using a negative phase rotation sequence for local surrounding beams and the right hand null is formed using a positive phase rotation. Comparing the two innermost rings around the left and right hand nulls, it can be observed that the ring around the left hand null has greater phase variation between adjacent beams than the ring around the right hand null. This may lead one to conclude that $M=+1$ should always be chosen. However, if the best antenna coverage is desired in certain "flank" regions (areas outlined by the dashes in FIG. 14), it will be observed that adjacent beams on either side of the dashed outline are very close in phase and therefore would provide for good high gain coverage. This is in contrast to FIG. 13 where M is chosen to be +1 for both nulls and the beams in the flank regions have a relatively greater phase difference than those in FIG. 14.

Figure 7A:
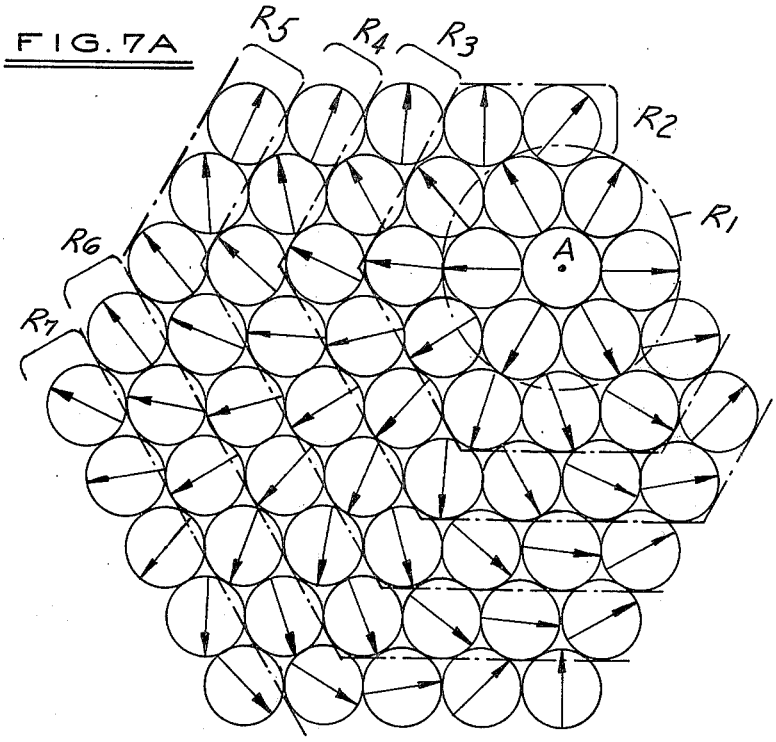
Figure 7B:
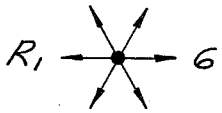
Figure 7C:
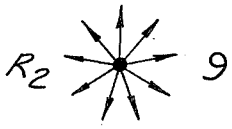
Figure 7D:
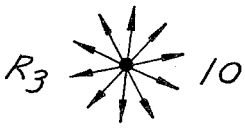
Figure 7E:
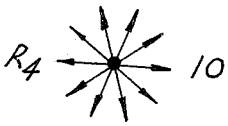
Figure 7F:
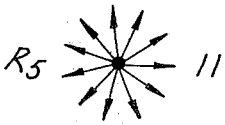
Figure 7G:
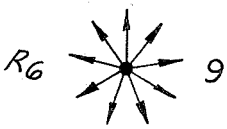

Referring again to FIG. 7, and in particular to ring $R_2$, it can be appreciated that adjacent beams can have phases which are any two of the phasors shown in FIG. 7*c*. However, as discussed before, considerations such as the desired uniformity of coverage of the antenna make it desirable that adjacent beams have adjacent phasors which have a minimum phase difference shown in FIG. 7*c*. Analogously, the choice of the relative circumferential position of the sequential association between the beams and the phasors is arbitrary, but considerations such as uniformity of beam coverage may dictate that there be a minimum phase difference between adjacent beams of different rings.

Figure 7H:
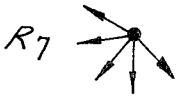

With respect to ring $R_7$ of FIGS. 7(a) and 7(h), the rule of spacing the phases of the signals applied to the beams and the ring around the entire 360° is not followed. Although this rule should be followed if complete cancellation is desired at the null, there are other considerations. If the phases are spaced through the entire 360° in ring 7, the adjacent phases of the beams in ring 6 may be radically different from the adjacent beams in ring 7. Thus, there would be strong cancellation of energy between rings 6 and 7. This is not desirable, because at such points in the antenna beam coverage we generally desire high gain coverage and do not desire the creation of additional nulls.

The sequence of phase rotation around the beams and rings such as 3, 4 and 5 creates a null at point A because point A is the only point that is nearly equidistant from all of the elements in any one of the given rings. That is, only at that point, point A, is the same relative signal strength from all the elements of the ring obtained to provide cancellation to produce the null. A particularly advantageous beam configuration is as shown in FIG. 7(a) wherein the beam elements are arranged as in a triangle. The particular advantage is that the centers of all beams adjacent any given beam are equidistant. Thus, each beam element can be part of a group of three beam elements wherein one element of the group of three touches the other two elements of the group of three. This is in contrast to an arrangement such as placing the centers of four beams at the corners of a square because the distance between beam centers on a diagonal of the square is not the same as the distance between beam centers along a side of the square.

In view of the preceding, the use of phasor rotation instead of the prior art subtraction method improves the retention of a null over a typical bandwidth, but may cause more ripple and somewhat lower gain over other portions of the antenna beam coverage. However, the increase in ripple and reduction in gain is sufficiently small that a typical bandwidth (e.g., 4%) can still be maintained over the antenna beam pattern coverage.

For practical antennas, the singlet patterns are not identical nor perfectly roll-symmetric, and this may cause each ring phasor set to be slightly unbalanced and thus not precisely zero. In this instance, the singlet, doublet or triplet beam set at or near the null point can be re-excited so as to cancel the residual non-nulled fields remaining after the ring-by-ring self-nulls have been attempted. Although this final subtraction tuning of the phase rotation null is not frequency independent in principle, it has been found to be very effective, since the ring-by-ring residual fields are usually quite small.

An embodiment of this invention can also include discrete steps in phase rotations between adjacent beams. FIG. 9 shows a quantized version of the $M=1$ phase rotation null excitation wherein 60° pie-shaped sectors of the beam grid are driven with constant amplitude and phase. The six beams of the innermost ring are given a 60° (i.e., 360° divided by 6) incremental phase advance as shown. Beams in the other rings have phases chosen from one of the six phases in the innermost ring.

FIG. 10 shows the application of a quantized phase rotation excitation ($M=1$) to produce a null at the crossover of two adjacent singlet beams. FIG. 11 shows a phase rotation excitation ($M=1$) to put a null at the intersection of three contiguous singlet beams. Uniform amplitude excitation has been found to work well in the cases of FIGS. 9 and 10 except that final subtractive adjustment of the contiguous doublet or triplet has been found helpful in further reducing the null depth.

A general rule for locating a phase rotation null at any point, not necessarily at the center of a singlet nor at the intersection of two or more contiguous beams, is illustrated in FIG. 12 for $m=1$. The rule is to locate the center (point 0) of a symmetrical vector field pattern at the point on the beam grid where the phase rotation null is desired. The phase excitation for each beam is the spatial angle that the beam center has been rotated about the center of the intended null.

When the null is at an arbitrary point, such as off the center of an antenna beam element, not only must the phase of the signal applied to the antenna beam element be considered, but also the amplitude must be considered, so that the sidelobes of the signals which are present at the null are cancelled by each other. Because there are numerous antenna elements generating signals, calculation of signal amplitudes to achieve the best cancellation at the null is most readily done using computers. When there is more than one null, the phases of elements spaced from the nulls are chosen to be a compromise between the values which would be the ideal for any single null. Again, the chosen compromise value can be calculated by a computer which compares the sidelobe which one antenna beam generates at the nulls to the other sidelobes present.

FIG. 13 shows the application of quantized phase rotation to the production of two separated nulls at the center points of two separated singlets. The two separated singlets are initially turned off and an $M=+1$ (counterclockwise) phase rotation excitation is applied to the non-intersecting rings of beams located around each null point. However, at point A the phase excitation pattern is that of a "source" (outward pointing excitation phasors) while at point B the phasor pattern is that of a "sink" (inward pointing phasors). The remaining two "flank" sectors of beams are each given excitation phase increments which provide a continuous "flow" of phase change and prevent any contiguous beams from having large differences of excitation phase. As noted above, the larger the phase differences the more the gain of the antenna pattern suffers. All excited beams are driven with equal amplitude. Finally, if desired, the singlets at the two null points can be adjusted in excitation so as to cancel at $f_o$ any undesired residual fields at the two desired null points.

FIG. 14 shows a different type of phase rotation excitation applied to the same two separated null points as in FIG. 13. Here the beams around point A are given the same $M=+1$ "source" phase excitation as in FIG. 13 but the rings of beams locally around B are given an $M=-1$ (clockwise) phase rotation as shown. The flank sectors are each given constant but opposing beam excitations as shown. For simplification, the beams in the flank sectors may be chosen to be non-adjustable and fixed in the same phase, after recognition of the fact that the beams in the flanks have phases in the same general direction. This variation merely represents an alternative choice in application of the phase rotation technique for producing two simultaneous nulls, and may or may not exhibit better patterns than the excitation shown in FIG. 13.

CALCULATED AND EXPERIMENTAL VERIFICATION

An illustration of the bandwidth improvement of the phase rotation excitations over the prior art subtraction excitations can be provided using a frequency sensitive waveguide lens design, as described by A. R. Dion and L. J. Ricardi in "A Variable Coverage Satellite Antenna System", Proc. IEEE, February 1971, pp 252–262, for use as a multiple beam antenna. For such a lens of diameter equal to 29.4 wavelengths (at $f_o$) and having $F/D=1.07$, a 61 horn triangular grid feed array was designed with the feed array located on a spherical surface of radius equal to focal length of the lens. Singlet beam widths are 2.0° and singlet spacings are 2.5°. The patterns of FIGS. 4 and 5 (prior art) were calculated with a scalar computer model of this antenna. Note that the 45 dB null set at $f_o$ filled in to a depth of only 16 dB for a ±1% frequency change. FIG. 8 is calculated for the same antenna but with the phase rotation excitations of FIG. 7. Note that the null depth stays below 20 dB for frequency changes spanning ±2% and that the smooth beam top and corresponding gain is not deteriorated.

For the excitation cases shown in FIGS. 7, 9, 10, 11, 13 and 14, null patterns have been calculated using specific embodiments. In all cases, the null depth was found to be 30 dB or deeper over an instantaneous bandwidth of at least 4%. The pattern shapes were all very similar to that of FIG. 8 with flat-top coverage and low peak-to-peak ripple. The null depth versus frequency calculated for several of these cases is shown in FIG. 15.

For contrast, the prior art beam subtraction null excitation results, calculated using the same waveguide lens design, are also shown in FIG. 15. For ±2% bandwidth the phase rotation method nulls are lower than −30 dB, but are only −10 dB for prior art subtraction.

Further, the invention has been successfully tested in an experimental multiple beam antenna (MBA). The antenna configuration is a waveguide lens similar to the design described in the previously cited article by Dion and Ricardi. This design consists of the waveguide lens, a 61 element feed array, and the beam-forming network that interconnects the elements of the feed array. The feed elements lie on a spherical surface which is centered at the center of the lens. Each feed element illuminates the entire lens, forming a secondary beam whose angular displacement from the antenna axis is equal to that of the feed element, assuming an origin at the center of the lens. The beam forming network enables the simultaneous excitation of any number of feed elements, from 1 to 61, in combination, and with variable amplitude and phase. Thus, the narrow constituent beams formed by each feed element can be combined to form shaped beams and the variety of coverages available is large.

Referring to FIG. 17, the eggcrate waveguide lens 30 is comprised of 1528 square pipes 31 with 1.004 inch inside dimensions and wall thickness 0.020 inch. An accuracy of 0.020 inch between centers was achieved on the position of each element, utilizing precision tooling for fabrication and precision optical techniques for assembly. The outside surface of the lens is formed in a spheroidal configuration with three steps, whereas the inside has a single spherical radius that has been machined to a 49.5±0.003 inch radius. A circular support ring used to contain the lens elements also provided a reference plane for alignment and convenient rotation in the range test fixture.

The feed array consists of 61 identical conical horn antenna feed elements 32 arranged in a triangular lattice and mounted on a 21.5 inch diameter spherical plate. Each horn element is excited in the $TE_{11}$ mode and has an aperture of 2.18 inches. A coaxial SMA probe excites the 1.160 inch diameter cylindrical section, into which a tempered G10 glass epoxy sheet has been inserted at 45° to the reference probe orientation. By using this technique, a circularly polarized wave is generated. In back of the probe, and perpendicular to it, an absorptive triangular card is utilized to prevent the energy reflecting off the back wall of the circular guide from being reradiated as an undesired crosspolarized signal.

The experimental coaxial beam forming network (BFN) is composed of phase-matched 0.14-inch semirigid cables with SMA connectors, 2-, 4- and 8- way power dividers, diode attenuators, and diode phase shifters. The network connects the 61 elements to a single beam port. The network was initially designed to provide for flexibility in realizing most of the prior art coverage modes of the MBA without regard to insertion loss. A five circular ring excitation format was established in which the excitation function (amplitude and phase) to each ring, with respect to its neighbors, was remotely controlled by circuitry located at the test console. Controls effect 0° to ±180° phase change and 0 to 40 dB attenuation in any ring of elements or in any other specific set of elements. Phasing cables, cut to 60° increments, are inserted before each horn so as to provide the excitation shown in FIG. 9. For this excitation, each ring's field should ideally be zero at the center; however, to cancel any actual small residual field at this point, the phase and amplitude of the center element can be controlled independently.

FIGS. 18, 19 and 20 show typical measured patterns over a 4% bandwidth. Spinning linear probe measurements were made to show the polarization present with the circularly polarized beam. FIG. 21 shows a summary of the measured null depth for the principal circularly polarized component over the many discrete frequencies measured. As can be seen, the null depth is greater than 25 dB over an 8% bandwidth. The cross circularly polarized components at the null are equally low over the 8% bandwidth.

The advantageous performance of an apparatus in accordance with this invention is clearly evident when these experimental results are compared to the best theoretical results for the prior antenna beam subtraction technique. The prior antenna (subtraction) null excitation performance was also measured, using the same multiple beam lens antenna model. The results confirm the prior art calculated null depth versus frequency data shown in FIG. 15.

Various modification and variations will no doubt occur to those skilled in the various arts to which this invention pertains. For example, particular antenna elements may be varied from those described herein. These and all other variations which basically rely on the teachings through which this disclosure has advanced the art are properly considered within the scope of this invention.

We claim:

1. An antenna assembly comprising:

a plurality of antenna elements for radiating and receiving electromagnetic energy;

a single processing means, such as a transmitter or receiver, for processing signals acted upon by said antenna assembly;

a beam forming network including a plurality of ports associated with said antenna elements and phase rotation means coupled between said processing means and said antenna elements for producing a substantially frequency independent null by adjusting the phase of a signal applied to each of said antenna elements so that with respect to a null point there are equidistant rings of beams with equal amplitude and phase increments of $$(M)\frac{360°}{N_R},$$

wherein $N_R$ is the number of beams per equidistant ring set and M is an integer;

said beam forming network including variable power divider means for splitting and combining power two ways in any ratio;

said beam forming network including variable phase shifter means coupled to said plurality of ports for adjusting the phase of the signal exciting each one of said plurality of ports associated with said antenna elements;

said variable phase shifter means being adapted to adjust the phase of adjacent beams in an equidistant ring with respect to the null point so that the phase difference between adjacent beams is $$(M)\frac{(360°)}{N_R},$$

the phase of the signal applied to one of said antenna elements being equal to the amount of rotation of the center of the antenna element about the null with respect to a reference line; and said variable power divider means being adapted to adjust the amplitude of phasors associated with the beams in an equidistant ring so that there are sequentially phased signal phasors adding to zero amplitude to form a null and any constituent beam sidelobe frequency changes remain balanced at the intended null direction thus cancelling out and maintaining an advantageously deep null in spite of a frequency change or increased bandwidth of a given signal.

2. An antenna assembly as recited in claim 1 further comprising:

a beam deletion means coupled to said antenna elements for turning off a narrow beam at the null point.

3. An antenna assembly as recited in claim 1 further comprising:

a beam subtraction means coupled to said antenna elements for adjusting the phase and magnitude of a signal at the null to eliminate any residual signal for at least one signal frequency applied to said antenna elements

4. An antenna assembly as recited in claim 1 wherein said antenna elements are arranged in concentric circles around the null.

5. An antenna assembly as recited in claim 4 wherein the null is coincident with one of said antenna elements.

6. An antenna assembly as recited in claim 4 wherein the null is positioned between two of said antenna elements.

7. An antenna assembly as recited in claim 1 wherein said phase rotation means includes means for establishing a plurality of nulls, with arbitrary locations, the relative phases of the beams around each of the nulls being changed by equal increments.

8. An antenna assembly as recited in claim 1 wherein the phase changes between all adjacent antenna elements is a discrete, fixed increment.

9. An antenna assembly as recited in claim 1 further comprising:

flank antenna elements having constant phase surrounding said antenna elements coupled to said phase rotation means so that the complexity of said antenna assembly is reduced, and antenna coverage in said flank areas is improved.

10. An antenna assembly as recited in claim 1 wherein said phase rotation means includes means for fixing the phase vector associated with adjacent antenna elements not centered about a null in accordance with the formula $M\phi$ wherein M is an integer, $\phi$ is the angle of the antenna element about the null center.

11. An antenna assembly as recited in claim 1 wherein said phase rotation means are adjusted so as to minimize the phase difference of the signals applied to adjacent ones of said antenna elements thereby maximizing the gain of said antenna assembly.

12. An antenna assembly as recited in claim 1 wherein said phase rotation means produces more than one substantially frequency independent null, each of the nulls being surrounded by antenna elements having a phase determined by the formula $$\frac{M(360°)}{N_R},$$

the transition of the phase of the signal applied to adjacent antenna elements being adjusted for minimum change.

13. An antenna assembly comprising:

a plurality of antenna elements for radiating and receiving electromagnetic energy;

a single processing means, such as a transmitter or receiver, for processing signals acted upon by said antenna assembly;

a beam forming network including a plurality of ports associated with said antenna elements and phase rotation means coupled between said processing means and said antenna elements for producing a substantially frequency independent null by adjusting the phase of a signal applied to each of said antenna elements so that with respect to a null point there are equidistant rings of beam with equal amplitude and phase increments of $$(M)\frac{(360°)}{N_R},$$

wherein $N_R$ is the number of beams per equidistant ring set and M is an integer;

said beam forming network including variable power divider means for splitting and combining power two ways in any ratio;

said beam forming network including variable phase shifter means coupled to said plurality of ports for adjusting the phase of the signal exciting each one of said plurality of ports associated with said antenna elements;

said variable phase shifter means being adapted to adjust the phase of adjacent beams in an equidistant ring with respect to the null point so that the phase difference between adjacent beams is $$(M)\frac{(360°)}{N_R},$$

the phase of the signal applied to one of said antenna elements being equal to the amount of rotation of the center of the antenna element about the null with respect to a reference line;

said variable power divider means being adapted to adjust the amplitude of phasors associated with the beams in an equidistant ring so that there are sequentially phased signal phasors adding to zero amplitude to form a null and any constituent beam sidelobe frequency changes remain balanced at the intended null direction thus cancelling out and maintaining an advantageously deep null in spite of a frequency change or increased bandwidth of a given signal; and said antenna elements being arranged so that each antenna element can be a part of a group of three antenna elements wherein each antenna element of said group of three antenna elements is adjacent the other two antenna elements of said group of three antenna elements.

14. An antenna assembly as recited in claim 13 wherein at least some of said antenna elements are part of a group which form an incomplete circle about the null.

15. A method of forming at least one null in a broad antenna beam coverage pattern including the steps of equally spacing the excitation phases of all elements equidistant from a null so they add up to zero and coupling the antenna radiating elements to a beam forming network;

inputing a signal to the beam forming network from a signal source;

processing the input signal through the beam forming network by successively splitting the power of the signal and adjusting the phase of the signal;

feeding the processed signal from the beam forming network to the antenna radiating elements;

said processing including shifting the phase of the signal so that the signal applied to adjacent beams in an equidistant ring with respect to the null point has a phase difference of $$(M)\frac{(360°)}{N_R}$$

wherein $N_R$ is the number of beams per equidistant ring set and M is an integer; and said processing including adjusting the amplitude of phasors associated with the beams in an equidistant ring so that there are sequentially phased signal phasors adding to zero amplitude to form a null and any constituent beam sidelobe frequency changes remain balanced at the intended null direction thus cancelling out and maintaining an advantageously deep null in spite of a frequency change or increased bandwidth of a given signal.

16. A method as recited in claim 15 wherein the step of equally spacing the excitation phases in accordance with the formula $M\phi$ wherein M is some integer and $\phi$ is the angle of the element about the null center.

17. A method as recited in claim 15 wherein choosing the amount of phase rotation of a signal applied to an antenna element includes determining the relative amount of spatial rotation of the center of that antenna element about the null position with respect to a reference line.

18. A method as recited in claim 16 further comprising the step of minimizing the phase difference of the signals applied to adjacent ones of the antenna elements thereby maximizing the gain of the antenna beam coverage pattern.

19. A method of reducing frequency dependence of a null formed in a substantially flat gain portion of the gain of a multiple beam antenna, including the steps of:

coupling antenna radiating elements of the multiple beam antenna to a beam forming network;

adjusting the phase of the excitation signal applied to the antenna elements of the multiple beam so that there are antenna elements equidistant from the null being self-nulled at the null by having relative phases so that the sidelobes of the signals at the null substantially cancel;

inputing a signal to the beam forming network from a signal source;

processing the input signal through the beam forming network by successively splitting the power of the signal and adjusting the phase of the signal;

feeding the processed signal from the beam forming network to the antenna radiating elements;

said processing including shifting the phase of the signal so that the signal applied to adjacent beams in an equidistant ring with respect to the null point has a phase difference of $$(M)\frac{(360°)}{N_R},$$

wherein $N_R$ is the number of beams per equidistant ring set and M is an integer; and said processing including adjusting the amplitude of phasors associated with the beams in an equidistant ring so that there are sequentially phased signal phasors adding to zero amplitude to form a null and any constituent beam sidelobe frequency changes remain balanced at the intended null direction thus cancelling out and maintaining an advantageously deep null in spite of a frequency change or increased bandwidth of a given signal.

20. A method as recited in claim 19 wherein the step of adjusting the phase includes spacing the phase of the excitation signal applied to adjacent antenna elements, which are equidistant from the null, by an amount equal to $(360°)/N_R$, where $N_R$ is the number of such equidistant antenna elements.

21. A method as recited in claim 20 further comprising the step of reducing dependence of the phase adjustment on the formula $(360°)/N_R$, with increasing distance from the null.

* * * * *